US005680711A

United States Patent [19]

Moratalla

[11] Patent Number: 5,680,711

[45] Date of Patent: Oct. 28, 1997

[54] THERMAL PROCESSING SYSTEM

[76] Inventor: Jose Moratalla, 3359 Lake Shore La., Clearwater, Fla. 34621

[21] Appl. No.: 609,713

[22] Filed: Mar. 1, 1996

[51] Int. Cl.[6] ..... F26B 21/06

[52] U.S. Cl. ..... 34/77

[58] Field of Search ..... 34/527, 535, 540, 34/569, 61, 62, 66, 68, 77, 272; 62/93; 432/66, 201, 233

[56] References Cited

U.S. PATENT DOCUMENTS

| | | | |
|---|---|---|---|
| 3,831,294 | 8/1974 | Freze | 34/77 X |
| 4,644,666 | 2/1987 | Eberle et al. | 34/77 X |
| 5,119,571 | 6/1992 | Beasley | 34/77 X |
| 5,179,998 | 1/1993 | Des Champs | 62/93 X |
| 5,230,166 | 7/1993 | Deng | 62/93 X |

*Primary Examiner*—John M. Sollecito
*Assistant Examiner*—Steve Gravini

[57] ABSTRACT

A system wherein air moves in a primary path over materials to be processed and wherein at least a portion of the air moves in a supplemental path for processing the air. Such system comprises a primary chamber of air for receiving material to be processed by a flow of air. The primary chamber has an air supply opening and an air return opening. A secondary chamber is provided for receiving air to be processed in a flow of air. The secondary chamber has an air supply opening and an air return opening. The air supply openings of the primary chamber are in flow communication with the air return opening of the secondary chamber and with the air return opening of the primary chamber being in flow communication with the air supply opening of the secondary chamber. The secondary chamber has a first path and a second path. A heat exchanger extends between the first path and the second path. An initial thermal member is located in the first path and is adapted to receive air from the heat exchanger and to initially process it for allowing passage of such initially processed air into the secondary path. A subsequent thermal member is located in the second path and is adapted to receive air from the heat exchanger and to subsequently process it and for allowing passage of such subsequently processed air into the oven.

15 Claims, 14 Drawing Sheets

PRIOR ART

OVENS

DRYERS

DRYER WITH HEAT RECOVERY

SPLIT WALL MOUNTED

PACKAGE CEILING/ROOF MOUNTED

PACKAGE WALL MOUNTED

SPLIT CEILING/ROOF MOUNTED

TOP VIEW - SPIRAL VORTEX
IS A TORNADO EFFECT

SIDE VIEW

SPEED OF AIR & TURBULENCE INCREASE THE MIXING RATIO OF PRIMARYAIR AND SECONDARY AIR.

DIFFUSER SIDE VIEW

DIFFUSER TOP VIEW

ASSEMBLY VIEW

THERMAL PROCESSING SYSTEM

BACKGROUND OF THE INVENTION

1. Field of the Invention

The present invention relates to a thermal processing system and, more particularly, pertains to providing a secondary chamber with a supplemental flow path for selectively heating, cooling, drying or otherwise processing air for use in processing material in an associated primary chamber.

2. Description of the Prior Art

The use of systems for heating, drying and for cooling or otherwise processing air of various designs and configurations are known in the prior art. More specifically, systems for processing air of various designs and configurations heretofore devised and utilized for the purpose of processing materials through heating, drying, cooling and diffusing air and the like through various methods and apparatuses are well known. Such known systems, however, consist basically of familiar, expected and obvious structural configurations, notwithstanding the myriad of designs encompassed by the crowded prior art which have been developed for the fulfillment of countless objectives and requirements.

In this respect, the thermal processing system wherein processed air moves in a closed loop primary path over material to be processed and through components for processing such air according to the present invention substantially departs from the conventional concepts and designs of the prior art, and in so doing provides an apparatus primarily developed for the purpose of providing a supplemental air flow path for heating and dehumidifying air for use.

Therefore, it can be appreciated that there exists a continuing need for new and improved thermal processing system wherein there is provided a secondary chamber with a supplemental flow path for selectively heating, cooling, drying or otherwise processing air for use in processing material in an associated primary chamber. In this regard, the present invention substantially fulfills this need.

SUMMARY OF THE INVENTION

In view of the foregoing disadvantages inherent in the known types of systems for processing materials of various designs and configurations now present in the prior art, the present invention provides an improved thermal processing system. As such, the general purpose of the present invention, which will be described subsequently in greater detail, is to provide a new and improved thermal processing system with a supplemental secondary chamber with a supplemental flow path for selectively heating, cooling, drying or otherwise processing air for use in processing material in an associated primary chamber which has all the advantages of the prior art and none of the disadvantages.

To attain this, the present invention essentially comprises, in the primary embodiment, a closed loop oven/drying system wherein dry hot air moves in a continuous primary path over materials to be heated and dried and wherein the air continuously moves in a continuous supplemental path for heating and drying the air comprising, in combination, an oven. The oven has a primary chamber for receiving material to be heated and dried by a continuous flow of air. The oven has an air supply opening and an air return opening. The oven openings are positioned for the continuous recirculation of air including the continuous passing of hot dry air into the oven after being heated and dried and the continuous passing of air from the oven after passing over the material to be heated and dried. A secondary chamber is provided for receiving air to be heated and dried in a continuous flow of air. The secondary chamber has an air supply opening and an air return opening. The secondary chamber openings are positioned for the continuous recirculation of air including the continuous passing of air from the secondary chamber after heating and drying and the continuous passing of hot dry air to the secondary chamber for being heated and dried. The air supply opening of the oven are in flow communication with the air return opening of the secondary chamber and with the air return opening of the oven being in flow communication with the air supply opening of the secondary chamber. The secondary chamber has a lower linear path for the receipt of air from the secondary chamber air supply opening for movement in a horizontal direction away from the oven and an upper linear path for the movement of air in a horizontal direction toward the oven with a generally vertical path extending between the upper and lower paths. A heat exchanger extends between the upper linear path and the lower linear path. An air conditioning system is located remote from the oven and secondary chamber and has a compressor and an accumulator and a condensing coil with coupling lines between the air conditioning system and the supplemental chamber. An evaporator coil is located in the first linear path and adapted to receive air from the heat exchanger and to cool it for allowing passage of such cooled air into the secondary linear path. The evaporator coil is coupled through the lines to the accumulator and the condensing coil. A reheat condenser is provided in the second linear path and adapted to receive air from the heat exchanger and to heat it and for allowing passage of such heated air into the oven. The reheater condenser is coupled through the lines to the condensing coil and the compressor. A heater is provided in the flow of air between the reheater condenser and the oven.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved thermal processing system. Such system includes a primary chamber of air for receiving material to be processed by a flow of air. The primary chamber has an air supply opening and an air return opening. The primary chamber openings are positioned for the flow of air including the passing of air into the primary chamber after being processed and the continuous passing of air from the oven after passing over the material to be processed. A secondary chamber is provided for receiving air to be processed in a flow of air. The secondary chamber has an air supply opening and an air return opening. The secondary chamber openings are positioned for the continuous flow of air including the continuous passing of processed air from the secondary chamber after processing and the continuous passing of air to the secondary chamber for being processed. The air supply openings of the primary chamber are in flow communication with the air return opening of the secondary chamber and with the air return opening of the primary chamber being in flow communication with the air supply opening of the secondary chamber. The secondary chamber has a first path for the receipt of air from the secondary chamber air supply opening for movement in a first direction away from the primary chamber and a second path for the movement of air in a second direction toward the primary chamber with an intermediate path extending between the first and second paths. A heat exchanger extends between the first path and the second path. An initial thermal member is located in the first path and is adapted to receive air from the heat exchanger and to initially process it for allowing passage of such initially processed air into the secondary path. A subsequent thermal member is located in the second path and is adapted to receive air from the heat exchanger and to subsequently process it and for allowing passage of such subsequently processed air into the oven.

It is another object of the present invention to provide a new and improved thermal processing system wherein hot dry air moves in a closed loop primary path over objects to be heated and dried which may be easily and efficiently manufactured and marketed.

It is another object of the present invention to provide a new and improved thermal processing system wherein cool dry air moves in a closed loop primary path over material to be cooled and dried so as to avoid thermal stress in the material.

It is a further object of the present invention to provide a new and improved thermal processing system wherein processed air moves in a closed loop primary path over material to be processed which is of a durable and reliable construction.

An even further object of the present invention is to provide a new and improved thermal processing system which is susceptible of a low cost of manufacture with regard to both materials and labor, and which accordingly is then susceptible of low prices of sale to the consuming public, thereby making such systems economically available to the buying public.

Lastly, it is an object of the present invention to provide a new and improved thermal processing system. Such system includes a primary chamber of air for receiving material to be processed by a flow of air. The primary chamber has an air supply opening and an air return opening. The primary chamber openings are positioned for the flow of air including the passing of air into the primary chamber after being processed and the continuous passing of air from the oven after passing over the material to be processed. A secondary chamber is provided for receiving air to be processed in a flow of air. The secondary chamber has an air supply opening and an air return opening. The secondary chamber openings are positioned for the continuous flow of air including the continuous passing of processed air from the secondary chamber after processing and the continuous passing of air to the secondary chamber for being processed. The air supply openings of the primary chamber are in flow communication with the air return opening of the secondary chamber and with the air return opening of the primary chamber being in flow communication with the air supply opening of the secondary chamber. The secondary chamber has a first path for the receipt of air from the secondary chamber air supply opening for movement in a first direction away from the primary chamber and a second path for the movement of air in a second direction toward the primary chamber with an intermediate path extending between the first and second paths. A heat exchanger extends between the first path and the second path. An initial thermal member is located in the first path and is adapted to receive air from the heat exchanger and to initially process it for allowing passage of such initially processed air into the secondary path. A subsequent thermal member is located in the second path and is adapted to receive air from the heat exchanger and to subsequently process it and for allowing passage of such subsequently processed air into the oven.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1A:
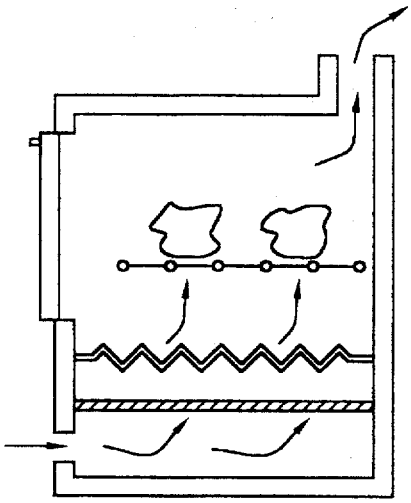
FIGURE 1A PRIOR ART
FIGS. 1A, 1B and 1C are illustrations of prior art devices including an oven, a dryer and a dryer with heat recovery.
Figure 1B:
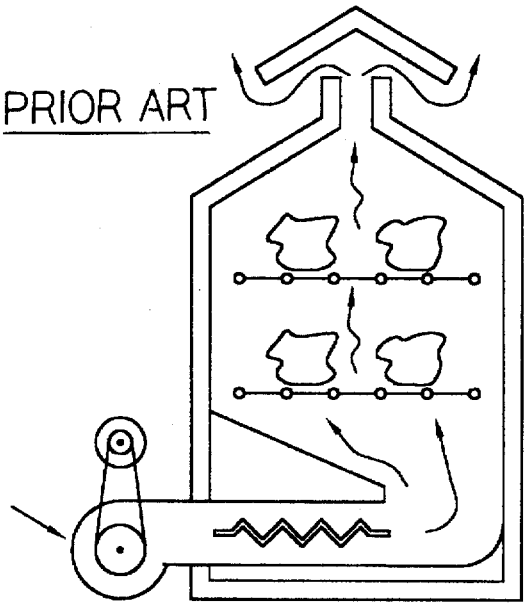
FIGURE 1B PRIOR ART
Figure 1C:
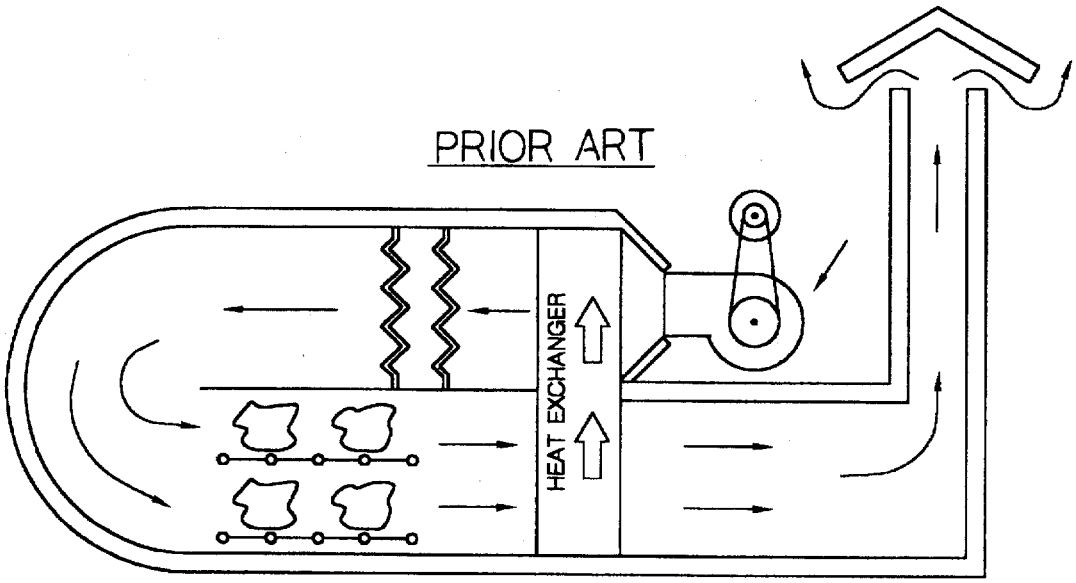

With reference now to the drawings, and in particular to FIG. 5 thereof, a new and improved thermal processing system embodying the principles and concepts of the present invention and generally designated by the reference numeral 10 will be described.

The present invention, the new and improved oven wherein dehumidified air moves in a closed loop primary path over material to be cooked and/or dried, is comprised of a plurality of components. Such components in their broadest context include an oven, a secondary chamber, a heat exchanger, an air conditioning system and a reheater. Such components are individually configured and correlated with respect to each other so as to attain the desired objective.

More specifically, a central component of the system 10 of the present invention is an oven 12. The oven has a primary chamber 14. Such chamber is for receiving material to be heated and dried by a continuous flow of air. The oven further includes an air supply opening 16. The oven also includes an air return opening 18. The oven openings are positioned for the continuous recirculation of air including the continuous passing of hot dry air into the oven after being heated and dried and the continuous passing of air from the oven after passing over the material to be heated and dried.

A next component of the system 10 of the present invention is a secondary chamber 22. Such secondary chamber is for receiving air to be heated and dried in a continuous flow of air. The secondary chamber has an air supply opening 24. It also has an air return opening 26. The secondary chamber openings are positioned for the continuous recirculation of air including the continuous passing of air from the secondary chamber after heating and drying and the continuous passing of hot dry air to the secondary chamber for being heated and dried. The air supply opening of the oven is in flow communication with the air return opening of the secondary chamber. In addition, the air return opening of the oven is in flow communication with the air supply opening of the secondary chamber.

The secondary chamber has a lower linear path 30. Such lower linear path is for the receipt of air from the secondary chamber air supply opening for movement in a horizontal direction away from the oven. It also has an upper linear path 32. Such upper linear path is for the movement of air in a horizontal direction toward the oven with a generally vertical path extending between the upper and lower paths.

Another major component of the system 10 of the present invention is a heat exchanger 36. Such heat exchanger extends between the upper linear path and the lower linear path.

A cooler 40 is located in the first linear path. The cooler is adapted to receive air from the heat exchanger and to cool it. This allows for passage of such cooled air into the secondary linear path. The cooler also includes a remote fluid cooling device 42.

Another component of the system 10 of the present invention is a reheater 46. Such reheater is located in the second linear path. The reheater is adapted to receive air from the heat exchanger and to heat it. This allows for the passage of such heated air into the oven. The reheater further includes a remote fluid heating device 48. It also includes lines 50 between the reheater and heating device.

Figure 3:
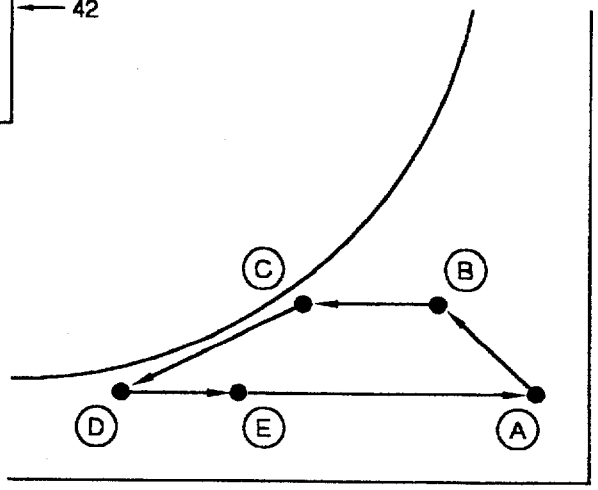
FIG. 3 is a simplified psychometric chart illustrating the change of conditions of the air as it moves through the system of FIG. 2.

FIG. 3 is a simplified phychometric chart illustrating the thermal conditions of the air as it passes through the system 10. Point A on the phychometric chart corresponds to the air supply opening of the oven while point B relates to the temperature of the air at the air return opening of the oven. Point B corresponds to the temperature of the air following the heat exchanger but prior to passage into the evaporator coil.

The temperature of the air between the evaporator coil and the upper linear path corresponds to point D. Point E represent the temperature of the air in the first linear path between the heat exchanger and the reheater condenser. The simplicity of the pattern of the air as traced on the psychometric chart illustrates the efficiency of the system.

Figure 2:
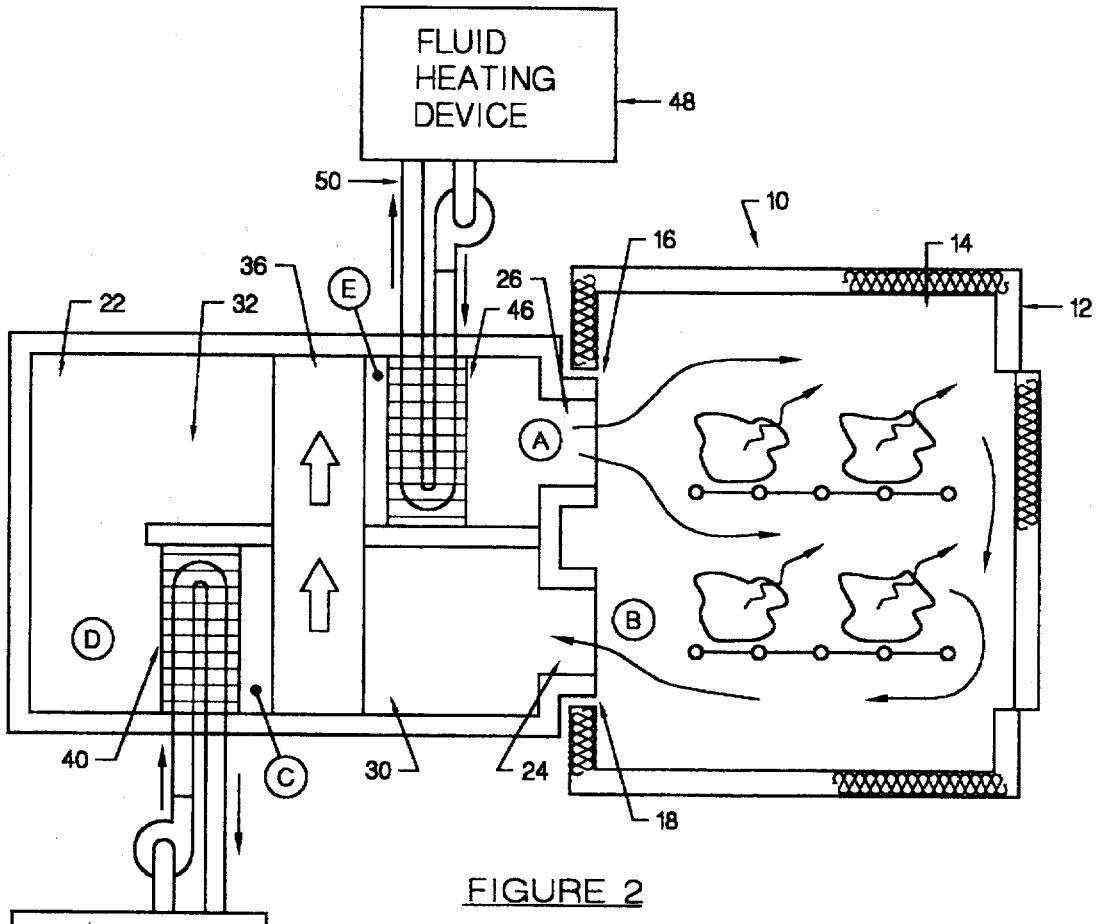
FIG. 2 is a side elevational view with parts removed to show internal constructions illustrating the primary embodiment of the present invention.
Figure 4:
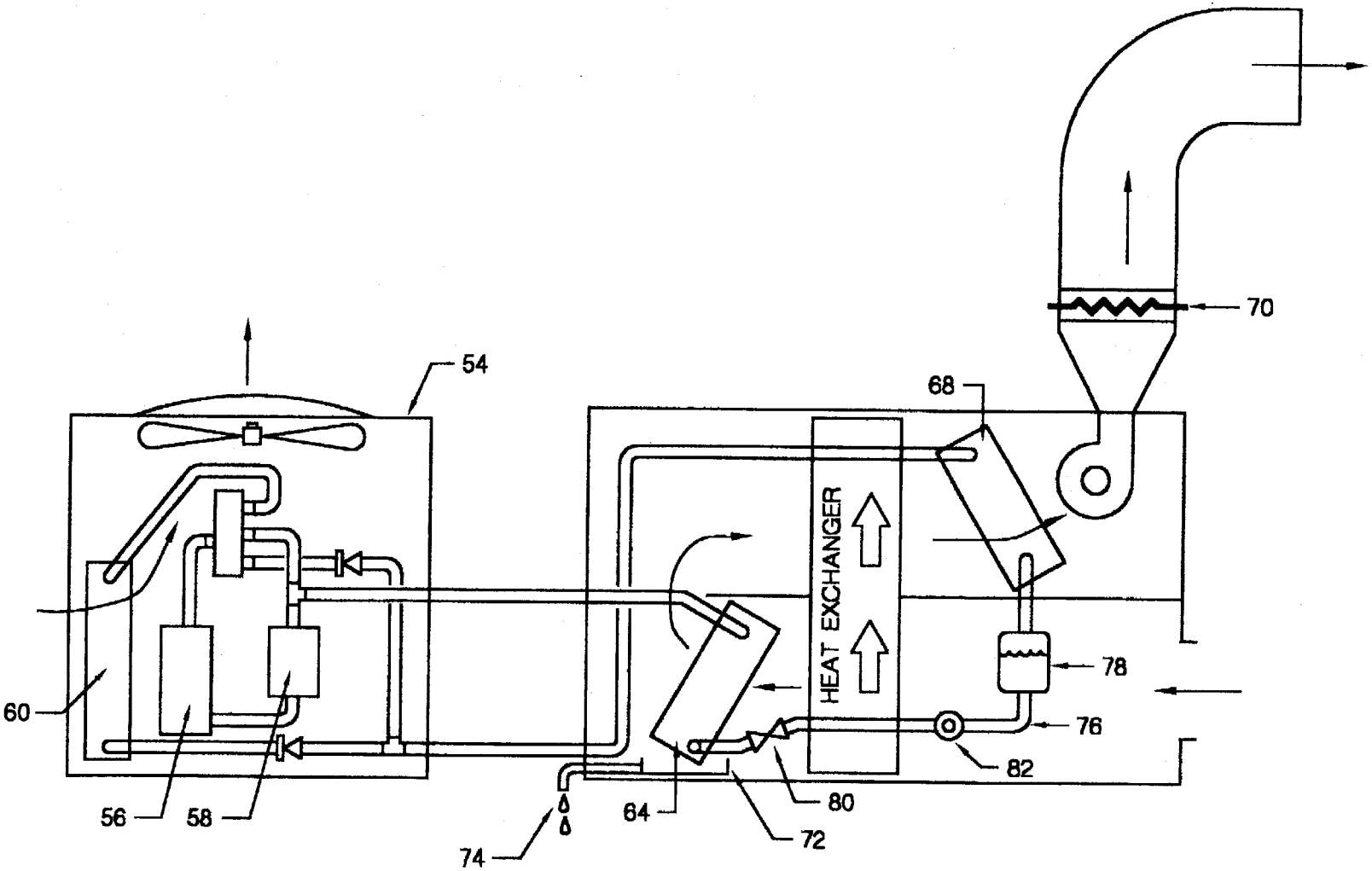
FIG. 4 is a side elevational view similar to FIG. 2 but illustrating in greater detail the interrelationship of the operating component.

As shown in FIG. 4, is a side elevational view with parts removed constituting a schematic illustration of the system shown in FIG. 2, but with the fluid cooler device and the fluid heating device being replaced by a unitary air conditioning system 54. Such air conditioning system has a compressor 56. The air conditioning system also has an accumulator 58 and a condensing coil 60 with coupling lines between the air conditioning system and the supplemental chamber.

Next provided is an evaporator coil 64. Such evaporator coil is located in the first linear path. The coil is adapted to receive air from the heat exchanger and to cool it. This allows for the passage of such cooled air into the secondary linear path. The evaporator coil is coupled through the lines to the accumulator and the condensing coil.

A reheat condenser 68 is located in the second linear path. Such reheat condenser is adapted to receive air from the heat exchanger and to heat it. This allows for the passage of such heated air into the oven. The reheater condenser is coupled through the lines to the condensing coil and the compressor.

A heater 70 is located in the flow of air between the reheater condenser and the oven.

Supplemental components within the FIG. 4 embodiment and not shown in FIG. 2 include a water drip pan with a drip pan 72 beneath the evaporator coil with an associated line 74 for removal of the condensate. In addition, a supplemental line 76 couples the reheat condenser and the evaporator coil with an associated receiver 78 within the line. In addition, an expansion device 80 and a sighting glass 82 are also provided in the line for efficiency of application and convenience of use.

Figure 5A:
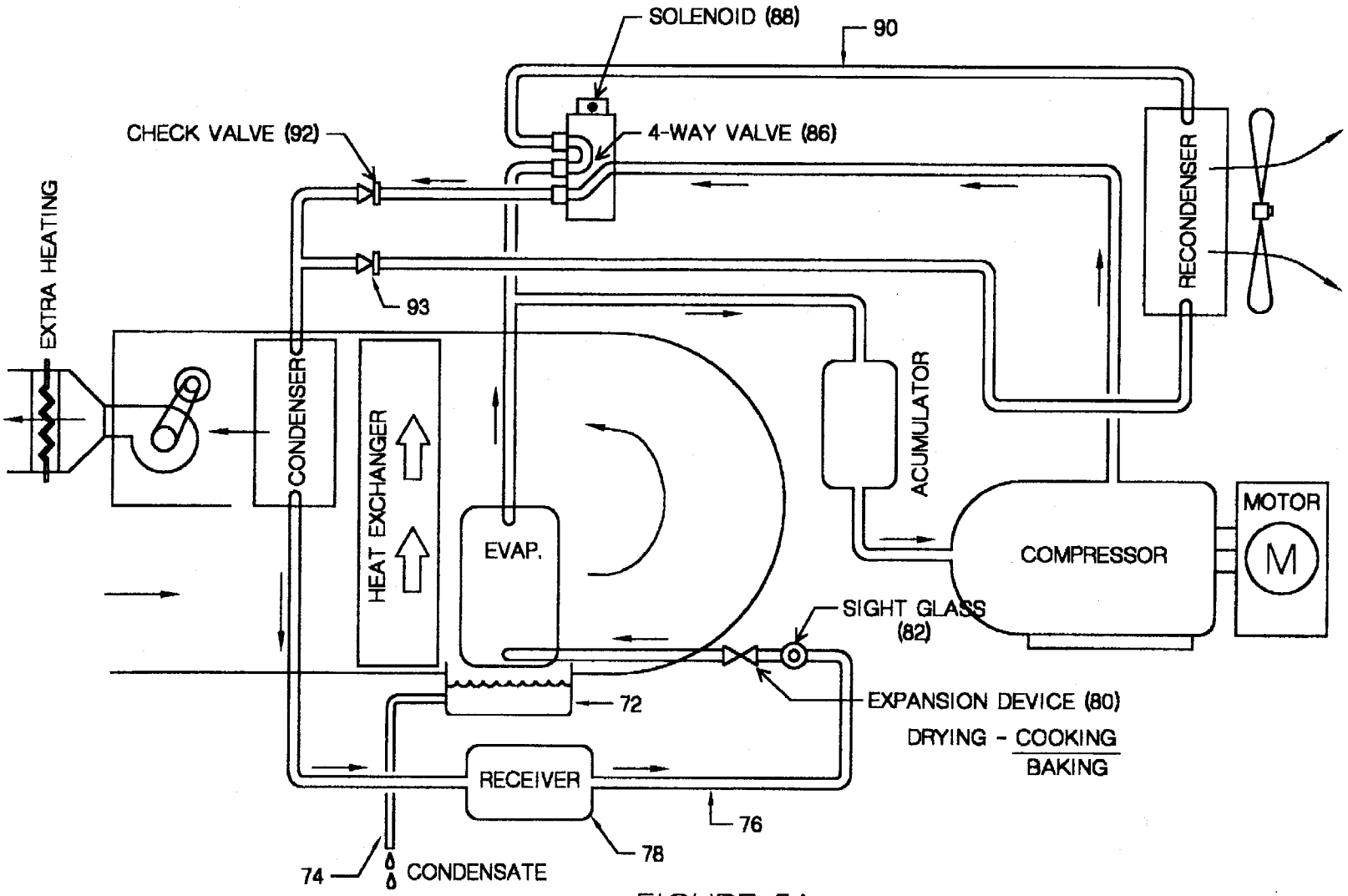
FIGS. 5A, 5B and 5C are schematic illustrations of the components in the supplemental chamber of FIG. 4 but illustrating arrangements for dry cooking and baking in FIG. 5A, cooling only in FIG. 5B and for alternate usage such as heating only in FIG. 5C.
Figure 5B:
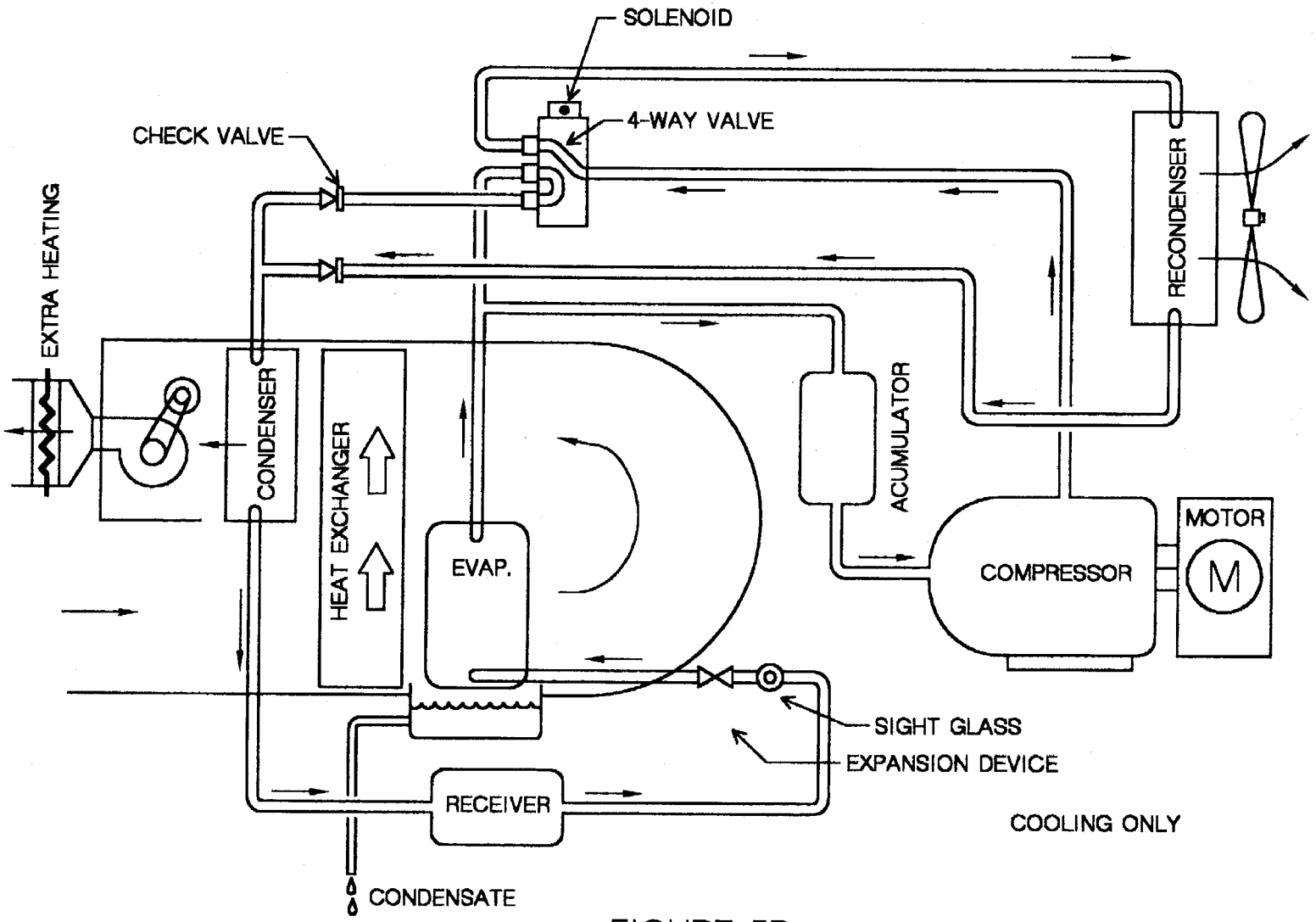
Figure 5C:
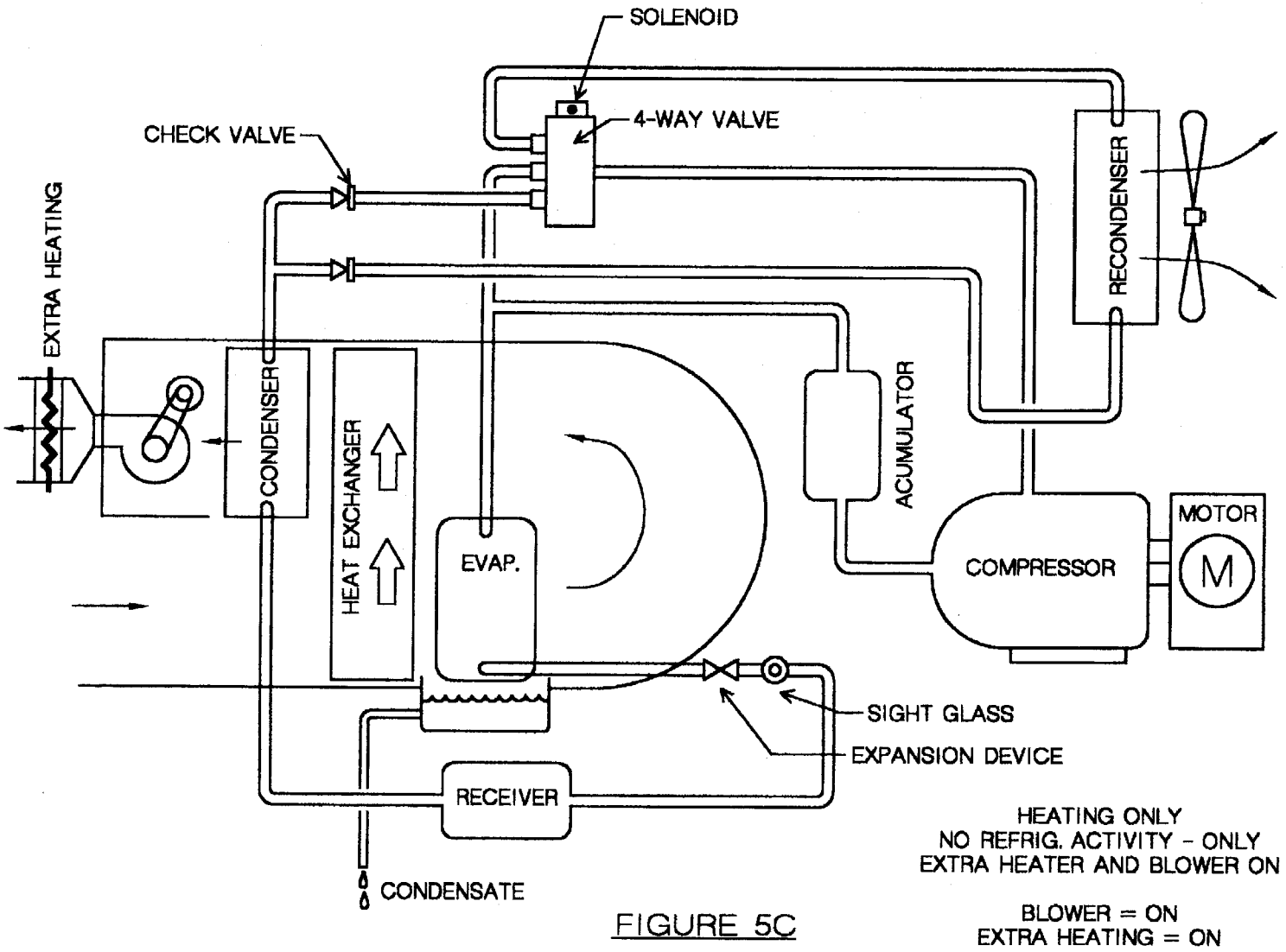

FIGS. 5A, 5B and 5C illustrate variations of the embodiment shown in FIG. 4. These embodiments differ from the FIG. 4 embodiment and from one another through the use of a four-way valve 86 and an associated solenoid 88. Such valve and solenoid are located to provide alternate flow paths for the fluid coolant between the air conditioning system and the components within the secondary chamber. In the FIG. 5A embodiment, the four-way valve is coupled to provide for drying, including cooking and baking. The uppermost line 90 couples one output of the four-way valve from the evaporator to the recondensor while directing the output of the compressor to the condenser. A check valve 92 is located in this line. A second check valve 88 is located in the line from the recondensor to the condenser. The flow of coolant is demonstrated by the various arrows in FIG. 5A.

In the FIG. 5B, the system is arranged for cooling only. In such embodiment, the four-way valve is coupled for directing the flow of fluid from the evaporator to the condenser through the first check valve as described above. In addition, the four-way valve directs the output of coolant from the compressor to the recondensor. The flow of coolant is shown by the arrows to effect the cooling function. In this manner, the air passing through the evaporator coil and the reheater condenser differs one from another. In the FIG. 5A embodiment, the air passing through the secondary chamber is heated. In other words the caloric content of the air passing through the secondary chamber is increased. Conversely, the air passing through the secondary chamber of the FIG. 5B embodiment has the caloric content of the air decreased, for cooling the air.

In the FIG. 5C embodiment, the four-way valve is shown without the specific orientation of the line directing mechanisms within the four-way valve. In such embodiment, the four-way valve is oriented to be moved from a first orientation as shown in FIG. 5A to a second orientation as shown in FIG. 5B for effecting a change in one direction or the other for heating and/or cooling at the discretion of the user.

Figure 6:
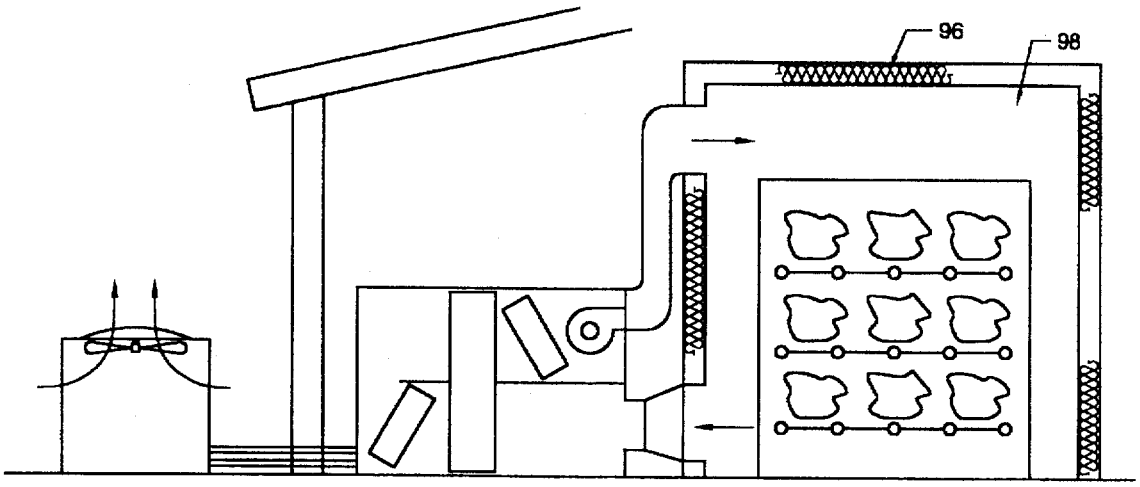
FIGS. 6 through 9 are side elevational views of the apparatus shown in FIGS. 3 through 5C but illustrating mounting techniques, FIG. 6 being an illustration for split wall mounting, FIG. 7 for package ceiling/roof mounting, FIG. 8 for package wall mounting and FIG. 9 for split ceiling/roof mounting.
Figure 7:
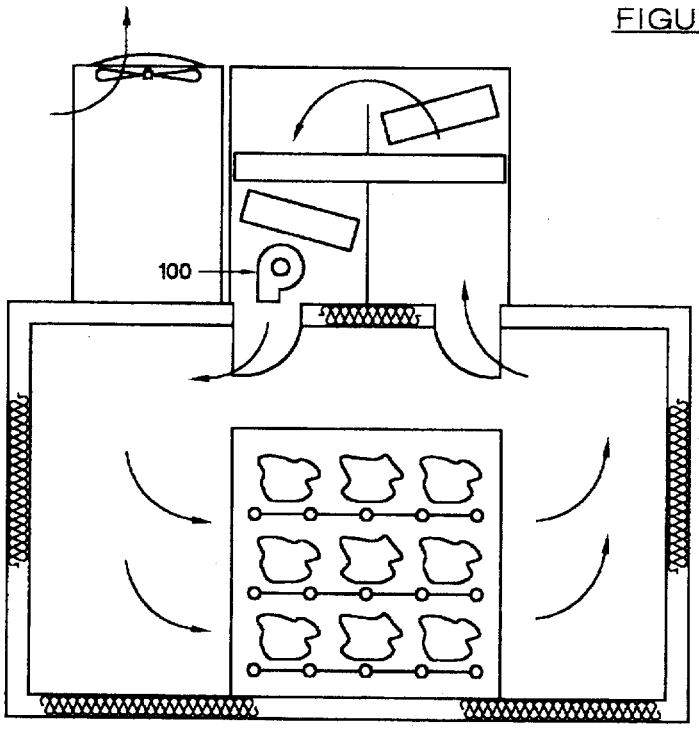
Figure 8:
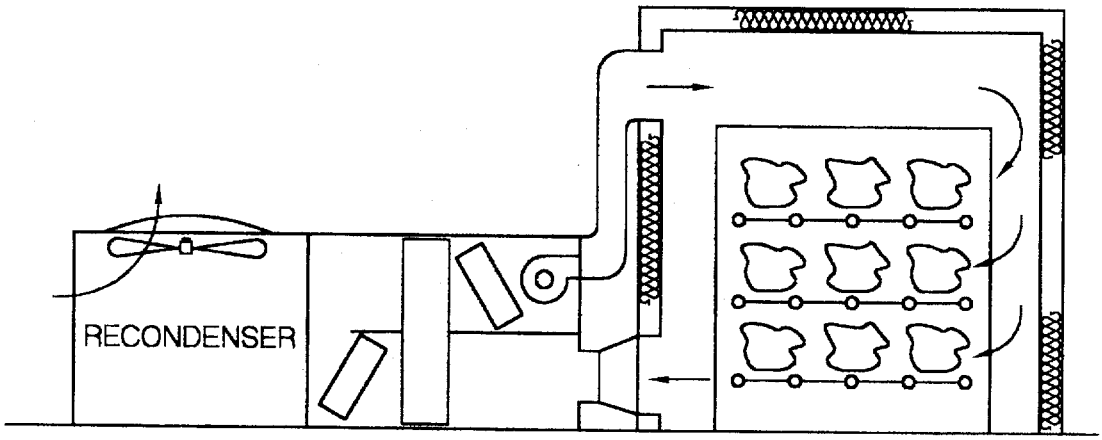
Figure 9:
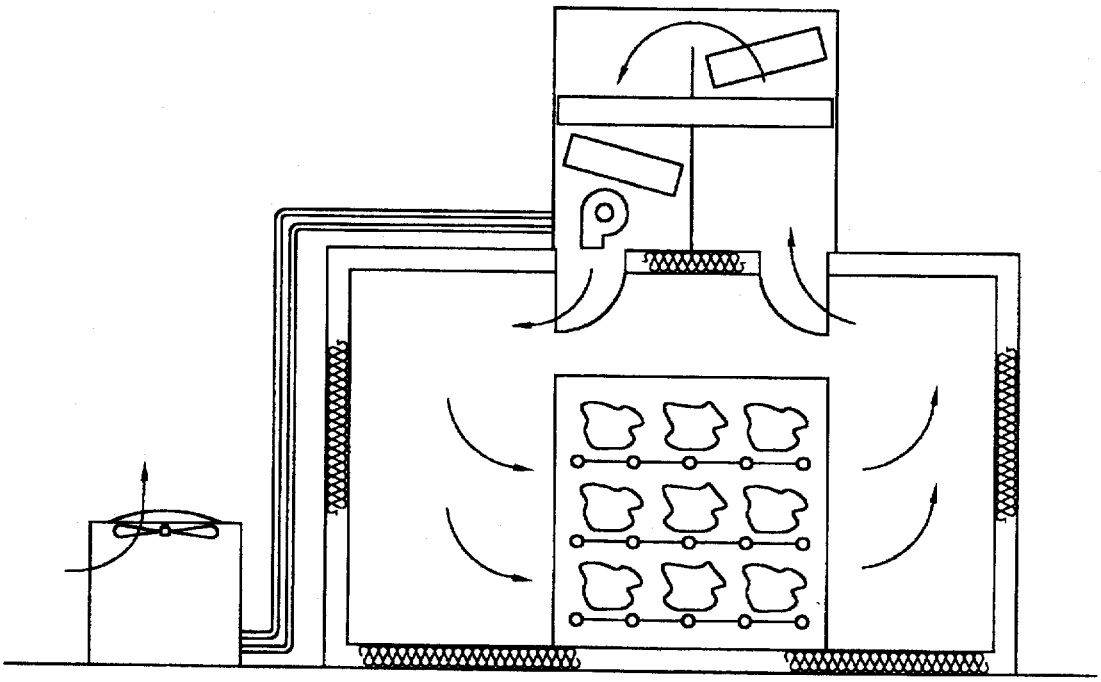
Figure 13:
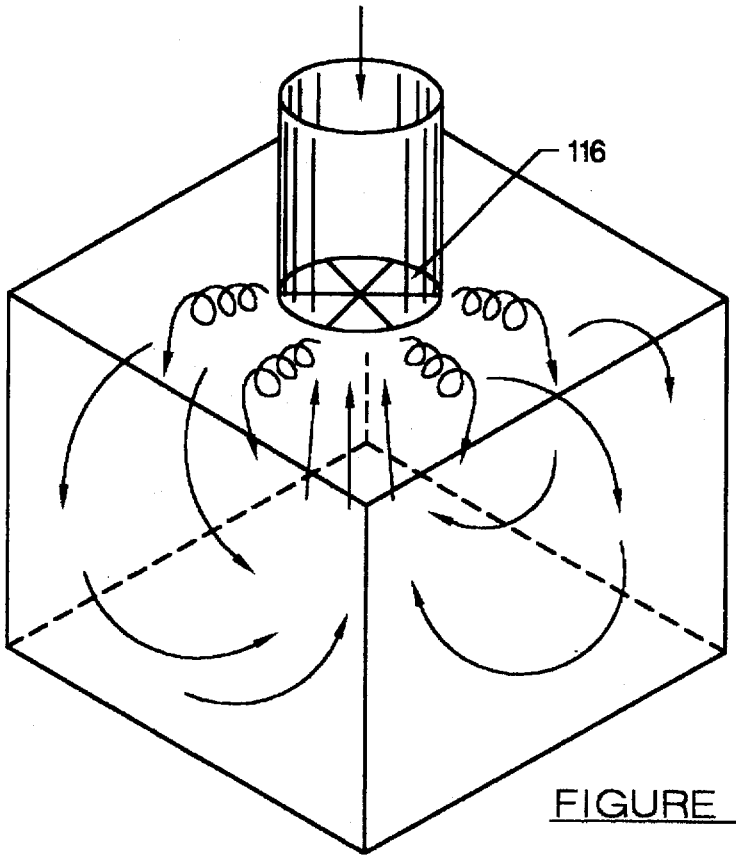
FIGS. 12 through 18 are illustrations of an alternate embodiment of the invention employing air diffusion achieved through a spiral vortex for a tornado effect.
Figure 14:
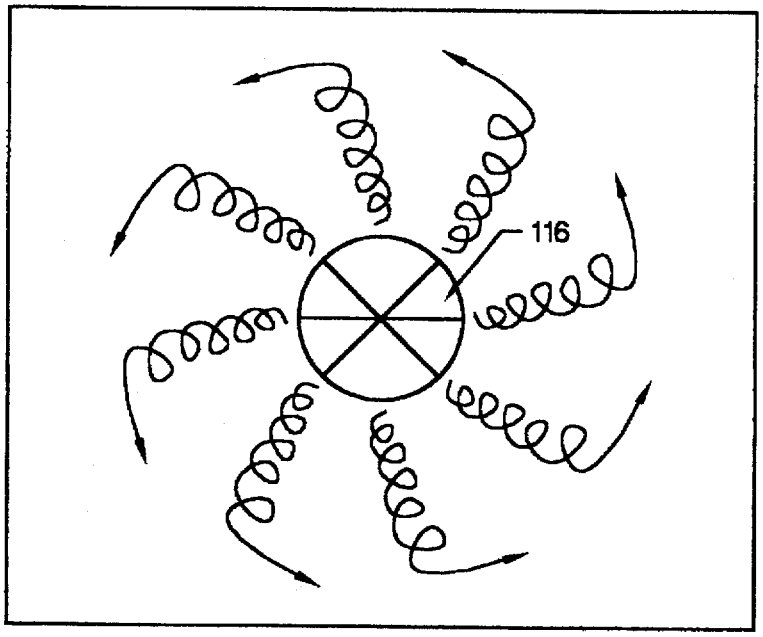

FIGS. 6 through 9 illustrate alternate embodiments for mounting the primary chamber and secondary chamber as well as the air conditioning system with respect to the location to be heated or cooled. In FIG. 6, there is shown a split wall mounted arrangement with the oven located within a chamber 94 having insulating walls 96. The secondary chamber is located there adjacent and all are located within a housing 98. The air conditioning system is located remove from the housing. The FIG. 7 embodiment is similar to the prior embodiments, but mounts the secondary chamber above the oven for the flow of air through the two linear paths in vertical orientations with a blower 100 located adjacent to the supply opening of the oven. The air conditioning systems are located exterior of the oven adjacent to the secondary chamber. In the FIG. 8 embodiment, there is shown a package wall mounted arrangement with the oven, secondary chamber and air conditioning system located contiguous with respect to each other and having the secondary chamber intermediate the air conditioning system and the oven. Lastly, the FIG. 9 embodiment illustrates a roof mounted unit similar to FIG. 7. In such embodiment, however, the air conditioning system is located remote from the secondary chamber to one side of the oven at a lower location.

Figure 11B:
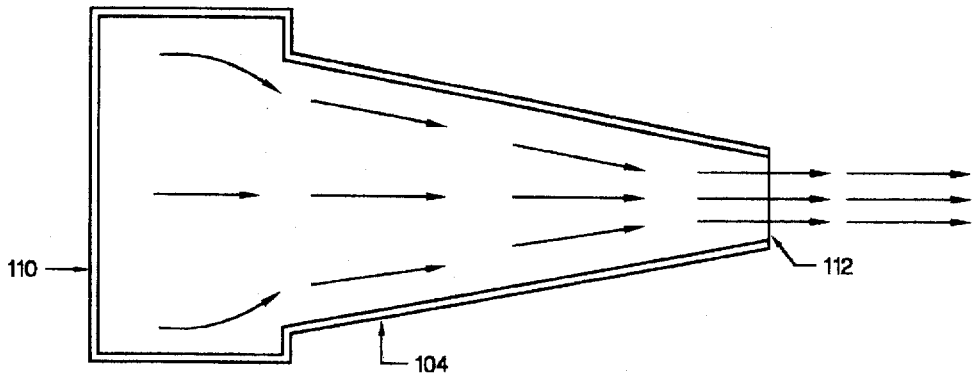
FIGS. 11A and 11B are respective a side elevational and a cross-sectional view of the nozzle shown in FIG. 10.
Figure 12:
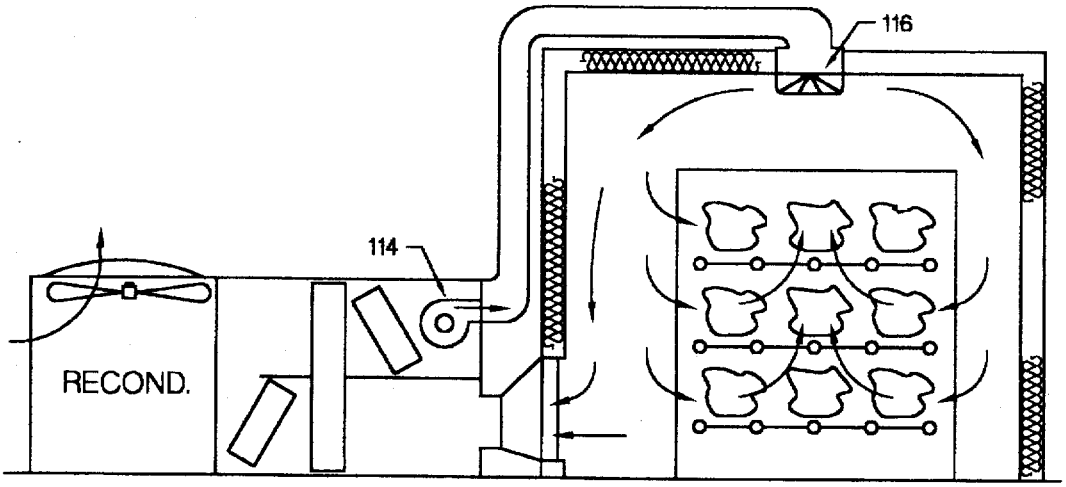
Figure 10:
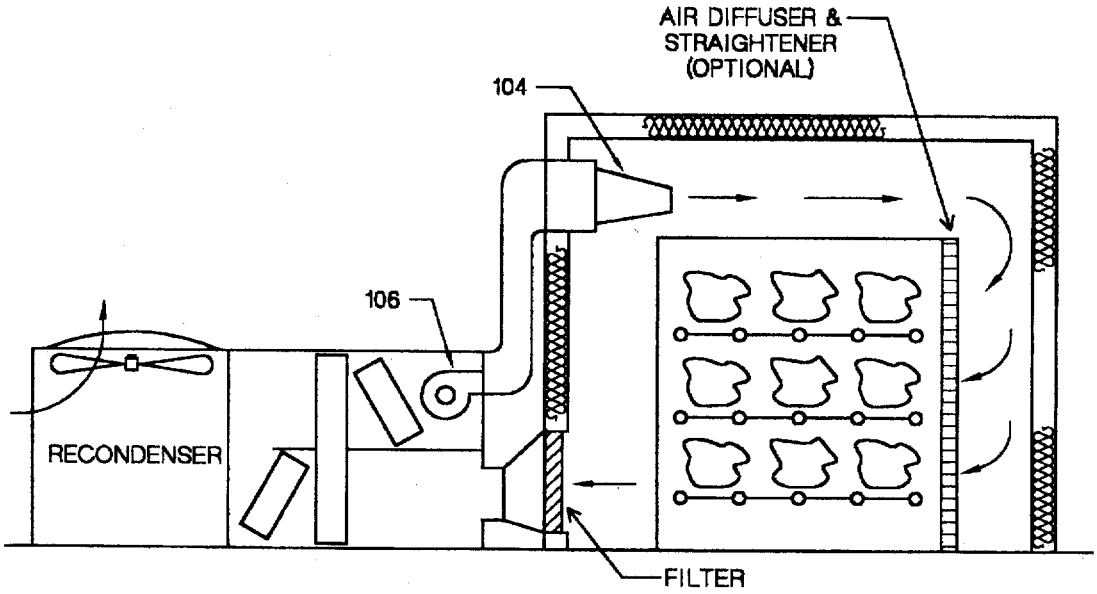
FIG. 10 is a side elevational view of the device shown in the prior Figures but illustrating an alternate embodiment employing nozzles for air diffusion.
Figure 11A:
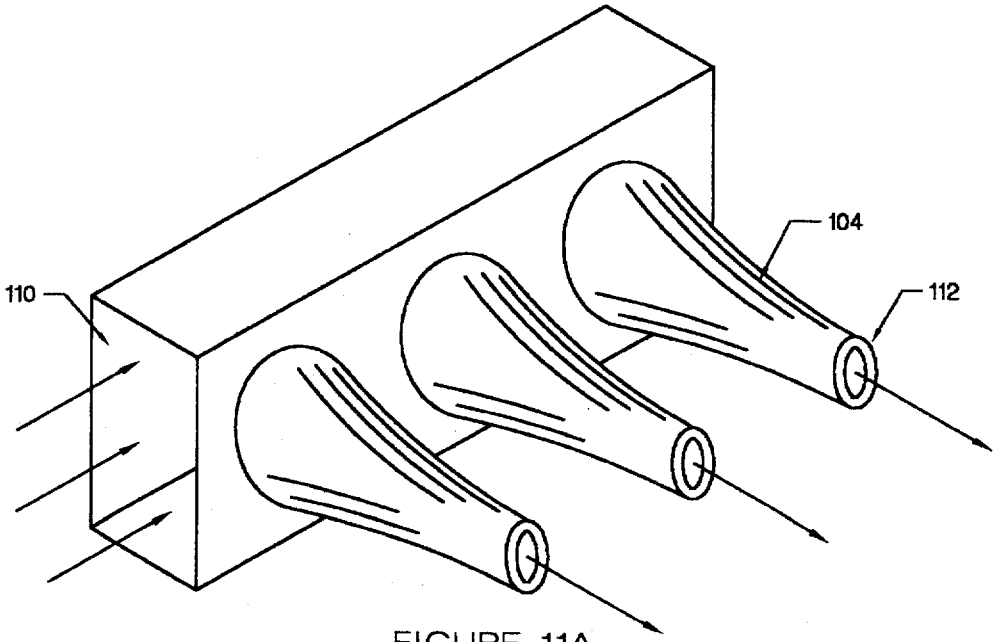
Figure 15:
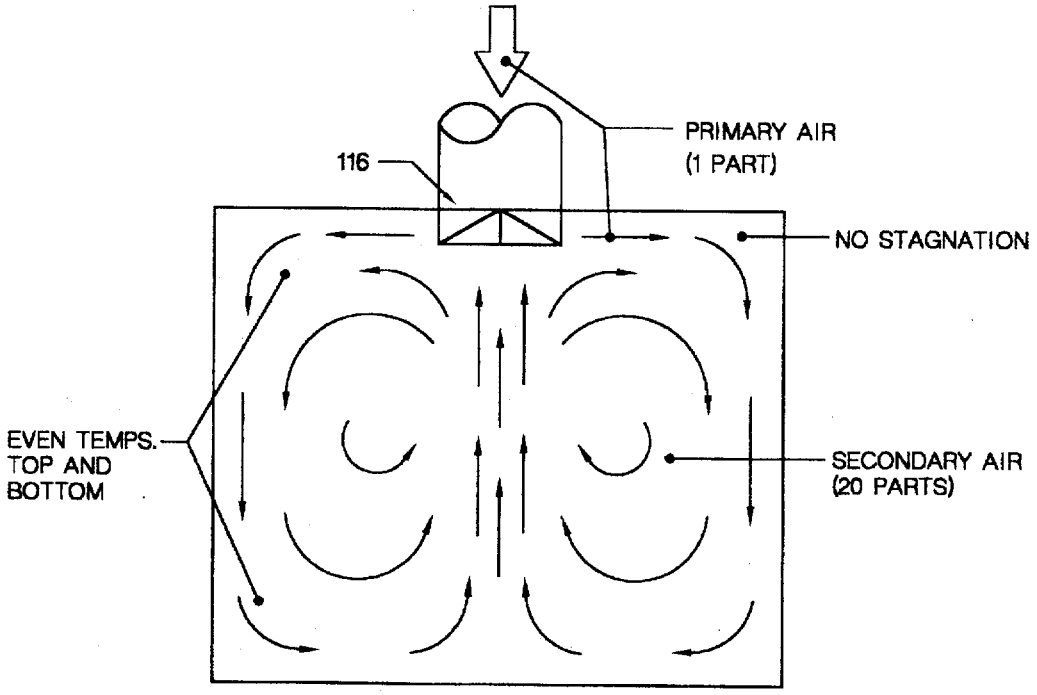
Figure 16:
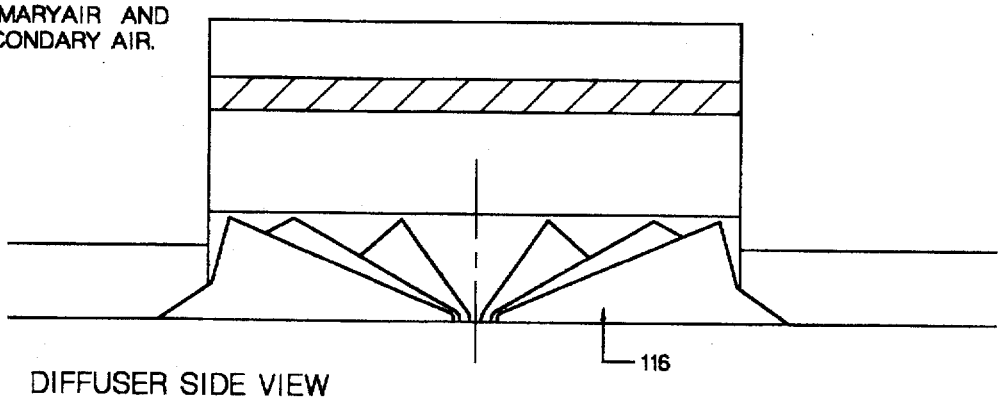
Figure 17:
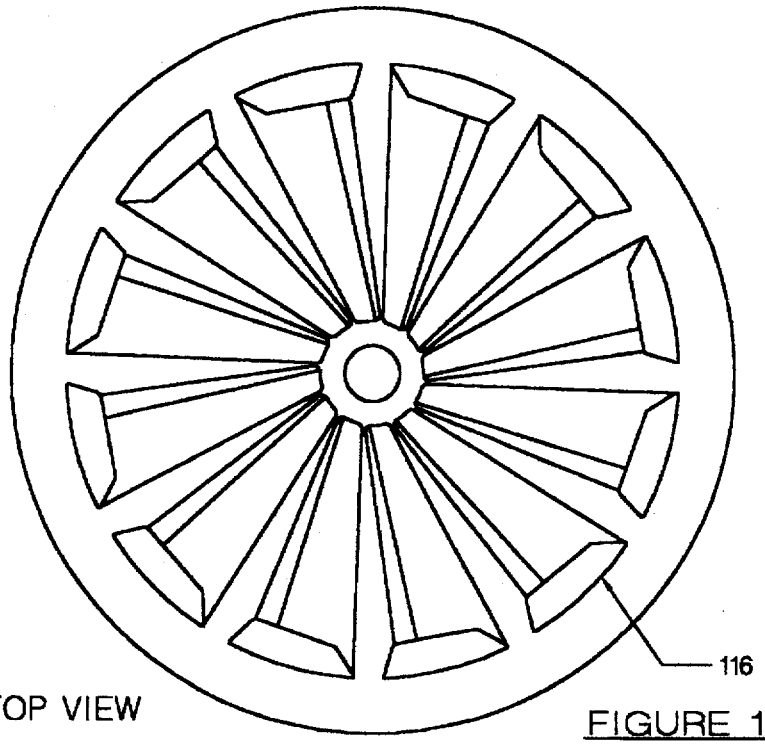
Figure 18:
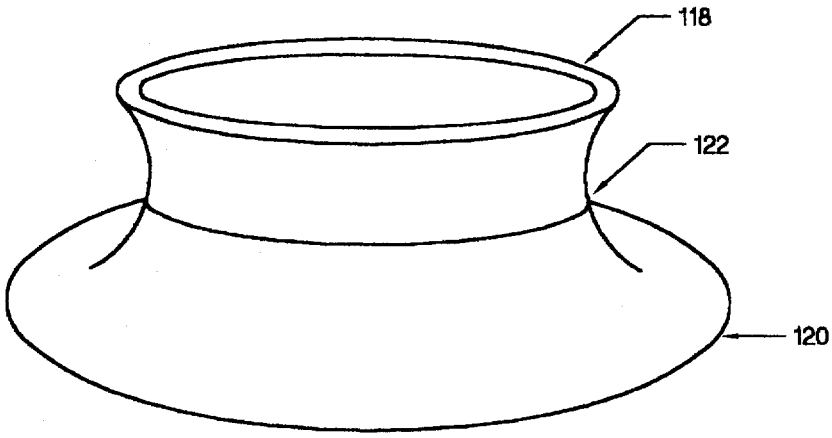
Figure 18:
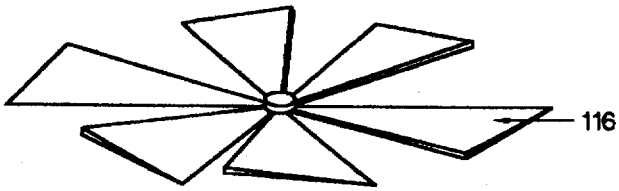

The embodiment of FIGS. 10, 11A and 11B is similar to that shown in the prior Figures, but supplements the air supply and air return openings of the oven through the utilization of a filter 102 in the air return opening of the oven, the air supply opening of the secondary chamber. Such embodiment also adds a plurality of nozzles 104. Such nozzles are located in the flow of air from the secondary chamber into the oven. In association therewith, there is provided a fan 106 and a duct 108 from the fan to oven. The end of such duct includes a plurality of nozzles. Such nozzles are located within the oven and constitute the air supply opening for the oven. Such nozzles have a wide input end 110 and a narrow output end 112. Such nozzles function to diffuse the air and provide turbulence to the air in the oven for the more efficient heating of the objects to be cooked or baked or otherwise dried through the hot dry air provided to the oven.

The embodiment of FIGS. 12 through 18 utilizes a spiral vortex assembly to achieve a tornado effect to the air supplied to the oven. This is effected through the utilization of a tubular input line from a fan 114 in the output of the secondary chamber. At the bottom of the line there is provided a fan 116 rotatable about a vertical axis and located within a contoured support having circular input and output ends 118, 120 and a constructed intermediate section 122. This arrangement of components effects the desired tornado effect to provide for even temperatures at the top and bottom of the oven with secondary air at intermediate regions within the chamber and no stagnation in the corners of the chamber. Note FIG. 15. The speed of the air and its turbulence increase the mixing ratio of primary and secondary air when utilized. This is particularly important when utilized with systems which include the addition of make-up air to the flow of recirculating air in its path of flow between the oven and the secondary chamber.

Figure 19:
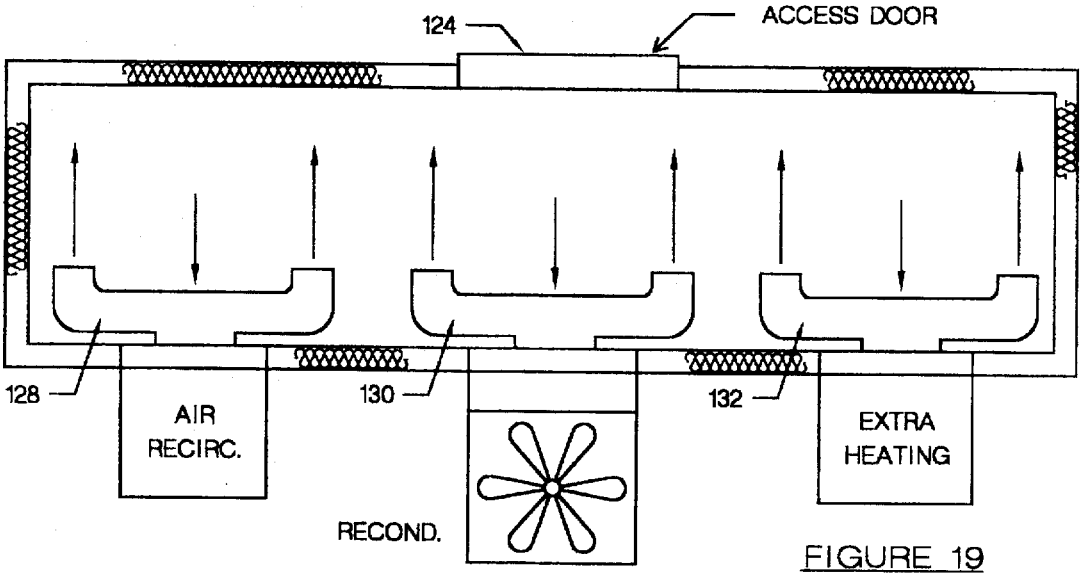
FIG. 19 illustrate yet a further alternate embodiment of the invention with separate air circulation, extra heating and reconditioning.
Figure 20:
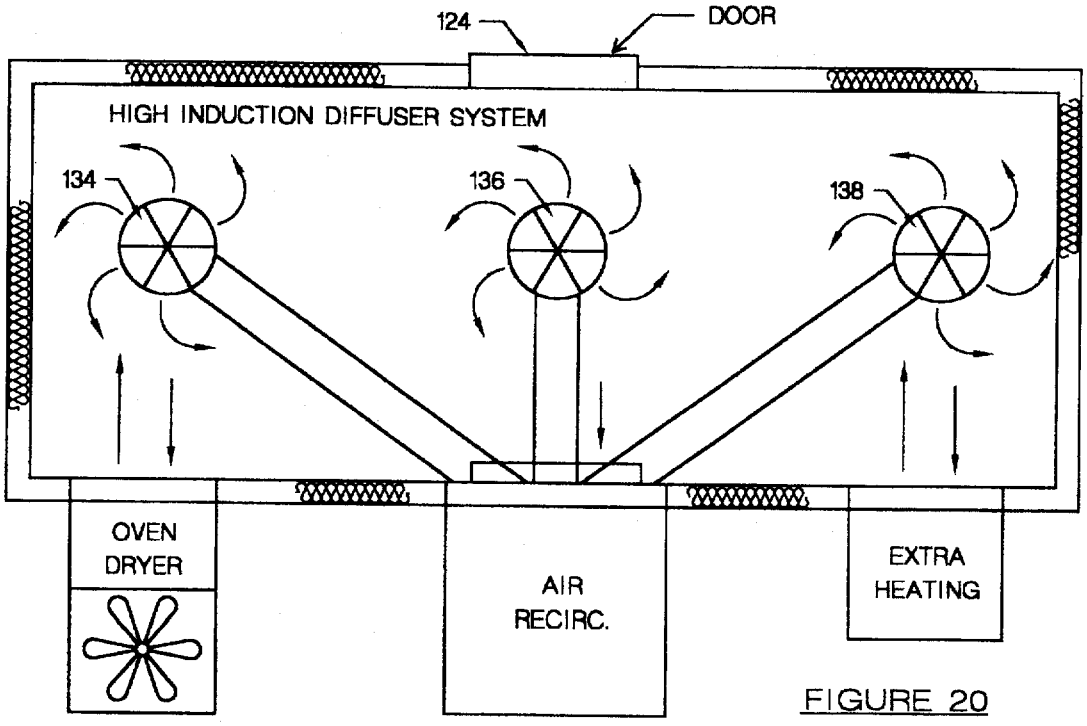
FIG. 20 illustrate yet a further alternate embodiment of the invention for a high induction diffuse system.

The last embodiments of the invention is shown in FIGS. 19 and 20. In the FIG. 19 system, an access door 124 is provided in the upper wall 126 of the oven for introducing the components to be dried through cooking or baking. Located on the lower wall of the oven are a plurality of separate blowers, inlet/outlet components 128, 130, 132. These components are for promoting the spiral vortex flow of air and the tornado effect of the embodiment shown in FIGS. 9 through 18. In the FIG. 19 embodiment, the components within the oven include an air recirculation component 128, the reconditioning component 130 as well as a component 132 for the extra heating.

The FIG. 20 embodiment is a high-induction diffuser system and includes an oven drier component with a fan 134, an air recirculation component with a fan 136 and an extra heating component with a fan 138. The various blowers/components with fans of the embodiments of FIGS. 19 and 20 are for improved heating and circulation with improved efficiency.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved closed loop oven/drying system wherein dry hot air moves in a continuous primary path over materials to be heated and dried and wherein the air continuously moves in a continuous supplemental path for heating and drying, the air comprising, in combination:

an oven having a primary chamber for receiving material to be heated and dried by a continuous flow of air, the oven having an air supply opening and an air return opening, the oven openings being positioned for the continuous recirculation of air, including the continuous passing of hot dry air into the oven after being heated and dried and the continuous passing of air from the oven after passing over the material to be heated and dried;

a secondary chamber for receiving air to be heated and dried in a continuous flow of air, the secondary chamber having an air supply opening and an air return opening, the secondary chamber openings being positioned for the continuous recirculation of air including the continuous passing of air from the secondary chamber after heating and drying and the continuous passing of hot dry air to the secondary chamber for being heated and dried, with the air supply opening of the oven being in flow communication with the air return opening of the secondary chamber and with the air return opening of the oven being in flow communication with the air supply opening of the secondary chamber;

the secondary chamber having a lower first linear path for the receipt of air from the secondary chamber air supply opening for movement in a first horizontal direction away from the oven and an upper second linear path above the first lower linear path for the movement of air in a second horizontal direction, opposite from the first horizontal direction, which is toward the oven with a generally vertical path extending between the upper second linear path and lower first linear path;

a passive heat exchanger having one portion in the upper second linear path for heating air and another portion beneath the one portion in the lower first linear path for cooling air;

an air conditioning system located remote from the oven and secondary chamber and having a compressor and an accumulator and a condensing coil with coupling lines between the air conditioning system and the supplemental chamber;

an evaporator coil located in the lower first linear path and adapted to receive air from the heat exchanger and to cool it for allowing passage of such cooled air into the upper second linear path, the evaporator coil being coupled through the lines to the accumulator and the condensing coil;

a reheater condenser in the upper second linear path and adapted to receive air from the heat exchanger and to heat it and for allowing passage of such heated air into the oven, the reheater condenser being coupled through the lines to condensing coil and the compressor; and a heater in the flow of air between the reheater condenser and the oven.

2. A closed loop oven/drying system wherein dry hot air moves in a continuous primary path over materials to be heated and dried and wherein at least a portion of the air continuously moves in a continuous supplemental path for heating and drying the air comprising, in combination:

an oven having a primary chamber for receiving material to be heated and dried by a continuous flow of air, the oven having an air supply opening and an air return opening, the oven openings being positioned for the continuous recirculation of air including the continuous passing of hot dry air into the oven after being heated and dried and the continuous passing of air from the oven after passing over the material to be heated and dried;

a secondary chamber for receiving air to be heated and dried in a continuous flow of air, the secondary chamber having an air supply opening and an air return opening, the secondary chamber openings being positioned for the continuous recirculation of air including the continuous passing of air from the secondary chamber after heating and drying and the continuous passing of hot dry air to the secondary chamber for being heated and dried, with the air supply opening of the oven being in flow communication with the air return opening of the secondary chamber and with the air return opening of the oven being in flow communication with the air supply opening of the secondary chamber;

the secondary chamber having a lower first linear path for the receipt of air from the secondary chamber air supply opening for movement in a first horizontal direction away from the oven and an upper second linear path above the lower first linear path for the movement of air in a second horizontal direction, opposite from the first horizontal direction, which is toward the oven with a generally vertical path extending between the upper second linear path and lower first linear path:

a passive heat exchanger having one portion in the upper second linear path for heating air and another portion beneath in the lower first linear path for cooling air;

a cooler located in the lower first linear path and adapted to receive air from the heat exchanger and to cool it for allowing passage of such cooled air into the upper second linear path, the cooler including a remote fluid cooling device therebetween; and a reheater located in the upper second linear path and adapted to receive air from the heat exchanger and to heat it and for allowing passage of such heated air into the oven, the reheater including a remote fluid heating device and lines therebetween.

3. A closed loop oven/drying system wherein air moves in a primary path over materials to be processed and wherein at least a portion of the air moves in a supplemental path for processing the air comprising, in combination:

a primary chamber of air for receiving material to be processed by a flow of air, the primary chamber having an air supply opening and an air return opening, the primary chamber openings being positioned for the flow of air including the passing of air into the primary chamber after being processed and the continuous passing of air from the oven after passing over the material to be processed;

a secondary chamber for receiving air to be processed in a flow of air, the secondary chamber having an air supply opening and an air return opening, the secondary chamber openings being positioned for the continuous flow of air including the continuous passing of processed air from the secondary chamber after processing and the continuous passing of air to the secondary chamber for being processed, with the air supply opening of the primary chamber being in flow communication with the air return opening of the secondary chamber and with the air return opening of the primary chamber being in flow communication with the air supply opening of the secondary chamber;

the secondary chamber having a first path for the receipt of air from the secondary chamber air supply opening for movement in a first direction away from the primary chamber and a second path offset and unaligned from the first path for the movement of air in a second direction, opposite from the first direction, which is toward the primary chamber with an intermediate path extending between the first and second paths;

a passive heat exchanger having one portion in the first path and another portion offset and unaligned from the one portion in the second path for heating air;

an initial thermal member located in the first path and adapted to receive air from the heat exchanger and to initially process it for allowing passage of such initially processed air into the secondary path; and a subsequent thermal member located in the second path and adapted to receive air from the heat exchanger and to subsequently process it and for allowing passage of such subsequently processed air into the primary chamber.

4. The system as set forth in claim 3 wherein the initial thermal member is a cooler.

5. The system as set forth in claim 4 wherein the cooler is an evaporator coil.

6. The system as set forth in claim 3 wherein the subsequent thermal member is a reheater.

7. The system as set forth in claim 6 wherein the reheater is a reheater condenser.

8. The system as set forth in claim 3 wherein the initial thermal member is an evaporator coil and the subsequent thermal member is a reheat condenser with the evaporator coil and reheat condenser and further including a air conditioning system coupled with respect to the evaporator coil and the reheat condenser.

9. The system as set forth in claim 3 wherein the initial thermal member is a cooling member and the subsequent thermal member is a reheater and wherein the cooler and reheater are coupled with respect to a remote system through a valve for effecting the heating and cooling of materials as a function of the setting of the valve.

10. The system as set forth in claim 3 wherein the system includes an air conditioning system coupled with respect to the secondary chamber at a remote location through a split wall mounting configuration.

11. The system as set forth in claim 3 wherein the system includes an air conditioning system operatively coupled to the secondary chamber, the secondary chamber and air conditioning system being mounted above the primary chamber in a package sealing roof mounted configuration.

12. The system as set forth in claim 3 and further including an air conditioning system with the air conditioning system, secondary chamber and oven in common alignment in a package wall mounted configuration.

13. The system as set forth in claim 3 wherein the secondary chamber is located above the primary chamber and further including an air conditioning system operatively coupled with the secondary chamber and located adjacent to the primary chamber remote from the secondary chamber.

14. The system as set forth in claim 3 and further including a plurality of air diffusers in the form of nozzles located at the air return of the secondary chamber for the flow of diffused air into the primary chamber.

15. The system as set forth in claim 3 and further including a plurality of fans within the oven for air recirculation, extra heating and reconditioning/oven drying in a high-induction diffuse system for air within the oven.

* * * * *